United States Patent [19]

Sullivan

[11] 4,113,189

[45] Sep. 12, 1978

[54] ROLLER-COLLOID MILL

[76] Inventor: Thomas A. Sullivan, 54 Felt St., Salem, Mass. 01970

[21] Appl. No.: 793,733

[22] Filed: May 4, 1977

[51] Int. Cl.[2] ..... B02C 23/38

[52] U.S. Cl. ..... 241/43; 241/46.04; 241/105; 241/163

[58] Field of Search ..... 241/43, 45, 46 R, 46.02, 241/46.04, 46.15, 103, 104, 105, 106, 152 A, 161, 162, 163

[56] References Cited

U.S. PATENT DOCUMENTS

| | | | |
|---|---|---|---|
| 1,352,797 | 9/1920 | Ellk | 241/104 |
| 1,897,157 | 2/1933 | Wells | 241/106 |
| 1,953,125 | 4/1934 | Parker | 241/43 |
| 2,204,140 | 6/1940 | Langbein | 241/105 |
| 2,934,278 | 4/1960 | Roberson | 241/163 |

*Primary Examiner*—Granville Y. Custer, Jr.
*Attorney, Agent, or Firm*—Kenway & Jenney

[57] ABSTRACT

A pressurized roller-colloid mill in which the conventional rotor and stator of a colloid mill are preceded by one or more adjustable-thrust roller bearing assemblies disposed in a series relationship. A product to be refined in the form of a slurry is pumped into the feeding port of the mill to pass between the rollers and the inner and outer raceways of one or more roller bearing assemblies, then to the gap between conventional rotor and stator elements of a colloid mill. The multiple rollers and their cooperating raceways constitute working surface areas far in excess of conventional colloid mill rotors and stators. Gang mounting of the rotor of the mill and the inner raceways of the roller bearing assemblies upon a common axially movable shaft permits gap adjustment for the enhancement of milling action. A relief valve at the outlet of the mill cooperates with the adjustable gap to provide an output of product of any desired particle size down to the low micron range.

9 Claims, 1 Drawing Figure

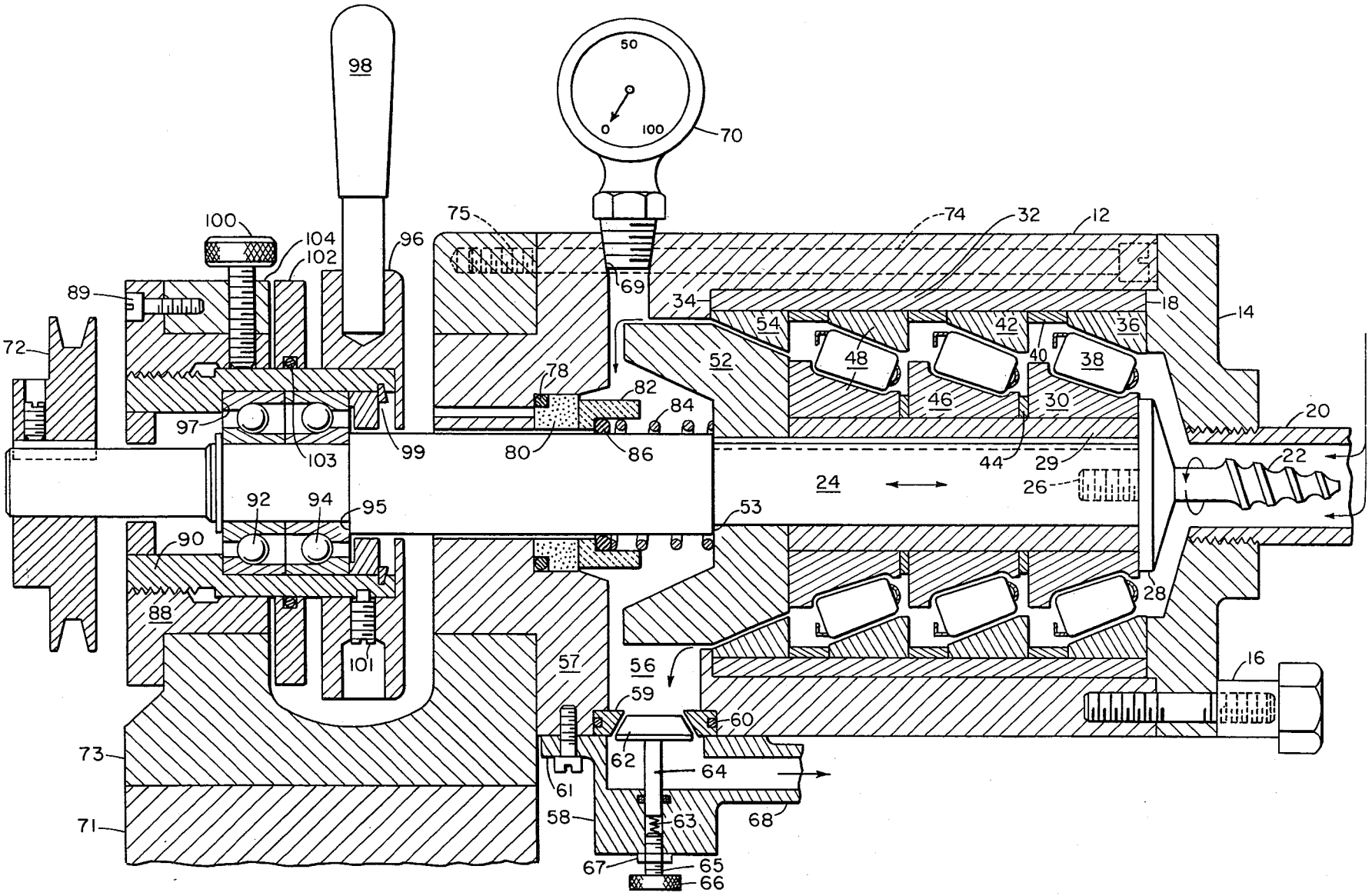
12
14
16
18
20
22
24
26
28
29
30
32
34
36
38
40
42
44
46
48
52
53
54
56
57
58
59
60
61
62
63
64
65
66
67
68
69
70
71
72
73
74
75
78
80
82
84
86
88
89
90
92
94
95
96
97
98
99
100
101
102
103
104
0
50
100

ROLLER-COLLOID MILL

BACKGROUND OF THE INVENTION

There are innumerable industries wherein milling is a necessary operation to refine a product to the point where it can be usefully employed. The products involved have ranged from rubber materials to foodstuffs to paints and enamels. More recently, the emulsification and homogenization of slurries of water, fuel oils and coal dust or particles especially for use as low cost fuel for jet injection in power plants has become an important application for milling equipment. In these and other applications the material to be milled or refined is in the form of a slurry containing solid particles and it is desired to reduce the size of the particles and to emulsify and disperse them throughout the product.

An early and still common type of mill is the so-called ball or pebble mill in which the product to be refined is placed in a container with balls or pebbles and the container is rotated on a rack in such a manner that the balls or pebbles crush and mix the solid particles. The process is notoriously slow and energy consumption in turning the mill is not only excessively high, it is largely wasted because as much as 75% of the energy is utilized in turning the balls or pebbles. Moreover, for obvious reasons, ball and pebble mills cannot be used with adhesive products.

Another common mill is the roller mill used in the production of paint and similar products. Often, sets of three, or sets of five rollers are employed and the material is simply spread upon the rollers and ground between them as they rotate. These machines are objectionable not only because of their great cost and the cumbersome nature of the structures but also because the material being treated is exposed to the atmosphere with attendant dangers to the operator and to the environment. In some instances, depending upon the product being treated, elaborate precautions must be taken to avoid operator injury and air pollution.

Conventional colloid mills avoid many of the drawbacks associated with ball mills and roller mills. These mills generally include an enclosure in which a rotor turns relative to a stator and slurry passes between these elements. The rotor smears a thin film of the slurry on the cooperating stator face and there is a hydraulic shear effect upon the product which can be accentuated by increasing rotor speed. However, with increased speed, slippage of the slurry and excess power consumption occur. Also, in many common slurries such as resins, oils or adhesive products, heat is generated because of the high rotor speed. It is often attempted to avoid such problems either by increasing the gap between the rotor and stator or by cooling the rotor, the stator, or both of them.

However, heat transfer between product and apparatus is not at all efficient and cooling of the apparatus is relatively ineffective in reducing temperature. Opening the gap between the rotor and stator is equally unavailing because the slurry passes through without sufficient refining taking place. Finally, if speed of the rotor is reduced, less heat may be generated but only at the cost of loss of work on the product because the smearing and shear effects are lessened and the particles in the slurry remain inadequately refined.

By way of specific example, if a paint film were being processed, the output product would have a texture comparable to sandpaper where the requirements are for a paint having a texture comparable to a glass surface.

BRIEF SUMMARY OF THE PRESENT INVENTION

The disadvantages of ball and pebble mills, of roller mills, and of conventional colloid mills have been outlined and the avoidance of those disadvantages is a primary object of the present invention. Briefly, that and other objects are realized by incorporating into an otherwise generally conventional colloid mill stacked roller bearing assemblies operating serially upon a product to be refined prior to its being passed through the stator and rotor of the colloid mill. By mounting and locking the rotor of the colloid mill and the inner raceways of the roller bearing assemblies upon a common driveshaft and making the locked assembly axially adjustable in position relative to the stator of the mill and the outer raceways of the bearing assemblies, which are mounted in the outer housing, it is possible to adjust the gaps between milling members to achieve an output product of optimized quality. More significantly, the action of the roller bearing assemblies upon the product is different in mechanical nature than that of conventional colloid mills. Instead of the smearing and shearing action of such mills, there is a rolling, crushing, and fracturing action upon the particles of the slurry being refined. Moreover, the slurry is passed between the rollers of each assembly and the inner raceways as well as between the rollers and the outer raceways. Each assembly includes multiple rollers and the surface area of the refining elements is accordingly multiplied. Finally, the effectiveness of the entire assembly in refining the product is enhanced by utilizing an adjusting mechanism which varies the thrust and pressure of the rollers. Such a mechanism is realized by mounting the inner raceways of the roller bearing assemblies upon a common shaft which also serves as the mount for the rotor of the mill.

Even better results are obtainable by increasing the residence time of the slurry between the rollers and their cooperating inner and outer raceways and between the rotor and stator of the colloid mill section. This may be achieved by incorporating an adjustable relief valve at the outlet port of the mill. Internal pressures generated by the feed pump may thus be maintained at any desired value to assure the desired residence time of the slurry.

For a better understanding of the present invention, the following description of a preferred embodiment of the invention should be read, referring to the appended drawing, the single FIGURE of which is a front elevation, partly in section, of a roller-colloid mill exhibiting features of the invention.

DESCRIPTION OF THE PREFERRED EMBODIMENT

In the drawing, there is shown a generally cylindrical housing 12 to the input end of which a cover 14 is attached by means of peripherally arranged studs and knobs. The studs extend from the housing and pass through the cover, the stud-and-knob 16 being typical. The cover also has a centering shoulder 18 which fits the inner diameter of the housing.

An input port 20 is threaded centrally into the cover and a worm impeller 22 is disposed for rotation within the input port 20. A central drive shaft 24 has an axial bore into which is threaded the extremity 26 of the impeller 22. A flange 28 also integral with the impeller and of larger diameter than that of the shaft 24 serves as an abutment to an interior sleeve 29 keyed to the shaft 24. A conical inner raceway 30 of a roller bearing is lightly pressed onto the sleeve 29 and also abuts the flange 28. The flange 28 actually serves to lock several serially arranged members to the shaft 24 as explained in greater detail below.

An external sleeve 32 is slide-fitted within the housing 12 and abuts against a shoulder 34 which projects inwardly of the housing 12. The sleeve 32 is held in fixed position by the cover shoulder 18 which bears upon the sleeve end opposite the shoulder 34. Lightly pressed into the sleeve 32 and also abutting against the cover shoulder 18 is a cup-shaped outer raceway 36. Between the inner raceway 30 and the outer raceway 36 a plurality of tapered rollers is disposed, the tapered roller 38 being typical. Actually, the assembly of the raceways 30 and 36 and the rollers 38 comprises a conventional roller bearing of the type sold commercially by the Timken Bearing Company.

A spacer ring 40 also pressed into the sleeve 32 is disposed between the outer raceway 36 and a similar outer raceway 42. A flat spacer 44 pressed onto the sleeve 29 is disposed between the inner raceway 30 and a similar inner raceway 46. A third roller bearing assembly 48 is similarly spaced from the second roller bearing assembly and its inner raceway abuts a rotor 52 which is similar to conventional rotors of known colloid mills. The rotor 52 is directly keyed to the shaft 24 and abuts a shoulder 53 formed on the shaft 24. The flange 28 thus serves to lock the assembly of inner raceways, spacers and rotor in fixed position on the shaft 24 against the shoulder 53.

The rotor 52 is arranged to operate in conjunction with a similarly conventional colloid mill stator 54. Beyond and surrounding the extremity of the stator is a cavity 56 the end wall of which is formed by a hub 57.

An opening for product output is formed in the wall of the housing 12 adjacent the cavity 56. A valve seat 59 is pressed in the opening and a seal is formed by means of an O-ring 60. A flange 61 is formed on a valve body 58 and the flange may be attached to the outer wall of the housing 12 by conventional means. The flange 61 serves to hold the valve seat 59 in place.

A tapered valve disc 62 conforming in shape to the valve seat 59 is urged toward a seated position by a spring 63 which is disposed between a stem 64 and a screw 65. The screw 65 is adjustable in position by means of a knob 66 and may be locked at any desired point by a lock nut 67. The valve body 58 includes an outlet extension 68 through which the output product flows. Openings such as the threaded opening 69 may also be formed through the wall of the housing 12 to accept instrumentation for monitoring temperature, pressure or the like, a pressure gauge 70 being shown as typical of instrumentation.

Material such as a slurry containing solid particles to be milled may be fed by a fixed or variable speed-controlled pump to the input port 20, then to pass serially between the roller bearing assemblies. From the last assembly 48, as shown here, it is passed to the gap between the motor 52 and the stator 54 of the colloid mill section. Milled material then enters the cavity 56 and is ultimately discharged through the outlet port 68.

The entire assembly may be supported upon a base 71 and power for rotating the shaft 24 may be derived from a motor and belt drive system, not shown, connected to a sheave 72 attached by conventional means to the end of the shaft 24.

Mounted upon the base 71 is a support bracket 73 to which the housing 12 is attached by peripherally disposed screws, the screw 74 being typical, which pass through the length of the housing and the hub 57 to be threaded as at 75 into the bracket 73. The hub 57 has a central opening through which the shaft 24 passes and a mechanical seal is formed between the shaft and the hub. The seal includes an O-ring 78 disposed between a shoulder formed in the hub 57 and a cooperating shoulder formed in a carbon ring 80. A ceramic cup 82 abuts the carbon ring 80 and contains an O-ring 86 against which one end of a compression spring 84 bears. At its opposite end, the compression spring 84 bears upon the central area of the stator 52, and it exerts pressure upon the ceramic cup 82 to maintain the integrity of the mechanical seal. For some applications, especially in very high pressure operations, more elaborate seals may be used, such as fluid pressurized double-face structures.

In order to permit adjustment of the gap between the rotor and stator of the colloid mill as well as the gaps between rollers and raceways of the roller bearing assemblies, an adjusting system is carried by the support bracket 73. The adjusting system includes a bushing 88 fitted into the support 73 and locked in position by peripheral screws, the screw 89 being typical. In the central opening of the bushing 88, there is threaded an adjusting cylinder 90. The shaft 24 passes centrally through the cylinder 90 and is supported in position for rotation by thrust bearings 92 and 94 which are locked in position in the cylinder 90 as explained below. The thrust bearings 92 and 94 have inner raceways pressed upon a section of reduced diameter of the shaft 24 and one inner raceway abuts a shoulder 95 formed by the junction of the full shaft and the section of reduced diameter. The locking of the thrust bearings 92 and 94 into the adjusting cylinder 90 is achieved by the abutment of the outer raceway against an internal shoulder 97 formed in the cylinder 90. The thrust bearings are held in their fixed position by a washer and snap-ring combination 99 fitted and locked in position in a recess formed in the adjusting cylinder 90.

Attached to the outer wall of the adjusting cylinder 90 by means of screws such as the lock screw 101 is a winch ring 96. The winch ring carries a winch handle or lever 98 which extends radially outwardly from the winch ring 96. The adjusting cylinder 90 is normally locked in position in the bushing 88 by means of a knurled lock screw 100. Upon release of the lock screw 100 by retracting it from the locking position, the adjusting cylinder 90 may be rotated in the bushing 88 by means of the winch ring 96 and the winch handle 98. By such rotation, the entire assembly carried by the shaft 24 may be moved axially varying the gaps of the colloid mill and the roller bearing assemblies simultaneously. For convenience, a ring 102 having line markings graduated, for example, in thousandths of an inch may be mounted upon the adjusting cylinder 90 and its position relative to a zero line marked on an adjacent wall 104 of the support 73 may provide a direct-reading measure of the gaps in the roller bearing assemblies and in the colloid mill section. The ring 102 may be made rotatable for reset purposes by utilizing an O-ring 103 between the ring 102 and the cylinder 90 as a friction mount.

In operation, the material to be refined, usually a vehicle containing pigments, fillers, minerals, abrasive powders or the like in the form of a pre-mixed slurry is pumped into the input port 20. It is generally desirable that a speed-controlled pump be used in order that the pressure applied to the slurry can be controlled.

Then, by adjustment of the outlet relief valve by rotation of the knob 66, pressure of the spring 63 upon the valve stem 64 can be varied to adjust the resistance to flow of the output product between the valve disk 62 and the valve seat 59. Such control permits adjustment of the retention time of the slurry between the rollers and both inner and outer raceways of the roller bearing assemblies as well as between the rotor and stator of the colloid mill.

As power is applied through the sheave 72, the shaft 24 rotates turning the rotor 52 relative to the stator 54 as well as the inner raceways of the bearing assemblies relative to the outer raceways. Slurry passes between the gaps on both sides of the rollers 38 and the raceways 30 and 36, respectively, and particles are rolled, fractured and crushed to accumulate in semi-refined condition in the cavity adjacent the spacer 40. The same action is repeated in the second roller bearing assembly and, again, in the third. Depending upon the degree of refinement desired, the number of roller bearing assemblies through which the slurry passes may be decreased or increased.

The pressure of the feed pump causes the slurry finally to pass between the rotor 52 and the stator 54 of the last stage, i.e. the colloid mill from which it enters the cavity 56 for discharge through the gap between the valve disk 62 and the valve seat 59 which is controlled by the pressure of the spring 63 as set by the knob 66. Final output is, of course, from the outlet extension 68. The internal pressure which is maintained by suitable adjustment of the relief valve and the increased residence time of the slurry between the working surfaces of the roller bearing assemblies and between the rotor and stator of the colloid mill section has the effect of completely wetting the particles which are subjected to the pressure and a completely homogenized output is attained. Such a homogeneous product is particularly desirable when the slurry being refined is for fuel purposes as, for example, the previously mentioned coal, coal dust, fuel oil and water slurries.

Rotation of the adjusting cylinder 90 is preferably effective to move the colloid mill rotor and the inner raceways and rollers from actual contact with the stator and outer raceways respectively at a zero position. The range of movement may be of the order of three-sixteenths (3/16) of an inch and as the gaps are increased, thrust contact occurs and operations normally take place with light to medium thrust contact. At the widest gap size, the rollers of the assemblies are freely disposed.

With the disclosed structure crushing action is accomplished at low speeds and with little generation of heat. Thus, no cooling water is needed. The product is enclosed during processing and the entire unit is light, small and conserving of energy. Also, the structure is inexpensive and easily maintained. Replacement of roller bearing assemblies is easy and cheap because standard commercial assemblies are utilized. A homogeneous output product having particles of size as small as a few microns can be obtained.

What is claimed is:

1. In a colloid mill having a housing enclosing a rotor and a stator for the treatment of a slurry containing solid particles, the combination with said rotor and stator of at least a roller bearing assembly disposed in said housing, said roller bearing assembly including a generally conical inner raceway and a generally cup-shaped outer raceway and a plurality of rollers disposed between said inner raceway and said outer raceway, and means for feeding said slurry into said roller bearing assembly between said rollers and said inner and outer raceways, said slurry passing from said roller bearing assembly to said rotor and stator for completion of said treatment of said slurry and discharge from said housing.

2. In a colloid mill as defined in claim 1, the combination of a shaft, means for mounting said inner raceway in fixed position on said shaft, means for mounting said outer raceway in said housing, and means for adjusting the position of said shaft relative to said housing to vary the spacing between said rollers and said raceways.

3. In a colloid mill as defined in claim 1, the combination wherein said means for feeding said slurry into said roller bearing assembly comprises a worm impeller on said rotor, an adjustable pressure-relief valve being disposed in operative relation to said housing to control the pressure therein.

4. In a colloid mill as defined in claim 2, the combination with said rotor and stator of a plurality of roller bearings mounted in series relationship with said means for feeding said slurry, each said inner raceway being mounted in a fixed position on said shaft and each said outer raceway being mounted in fixed position in said housing, adjustment of the position of said shaft relative to said housing varying the spacing between said rollers and their associated raceways.

5. In a colloid mill for the treatment of a slurry containing solid particles having a housing, a shaft mounted for rotation in said housing, a stator fixed in said housing, a rotor fixed to said shaft, means for rotating said shaft, means for feeding said slurry into said housing upstream of said rotor and stator and means for discharging said slurry downstream of said rotor and stator, the combination therewith of a plurality of serially disposed roller bearings, each having an inner raceway mounted in fixed position on said shaft, an outer raceway mounted in fixed position in said housing, and a plurality of rollers disposed between a cooperating set of inner and outer raceways, said slurry passing from said feeding means to a first of said roller bearings and passing between the rollers and raceways thereof thence serially between the rollers and raceways of succeeding roller bearings of said plurality and between said rotor and stator to said discharging means.

6. In a colloid mill as defined in claim 5, the combination wherein said feeding means comprises a worm impeller on said rotor, an adjustable pressure relief valve being incorporated in said discharging means whereby the internal pressure in said housing may be controlled.

7. In a colloid mill as defined in claim 5, the combination therewith of means for adjusting the axial position of said shaft relative to said housing and means for locking said shaft in a predetermined adjusted position related to the spacing between said rotor and said stator and the spacing between said rollers and their associated raceways.

8. In a colloid mill as defined in claim 5, the combination of an indicator attached to said means for adjusting the axial position of said shaft, said indicator being marked with graduations relating to the spacing between said stator and said rotor.

9. In a colloid mill as defined in claim 6, the combination wherein an opening is formed in said housing downstream of said rotor and stator, a pressure gauge being mounted on said housing and in communication with the interior thereof through said opening.

* * * * *